US005738726A

United States Patent [19]

Kaipf et al.

[11] Patent Number: 5,738,726

[45] Date of Patent: Apr. 14, 1998

[54] ROLL DOCTOR ASSEMBLY

[75] Inventors: Horst Kaipf, Lauingen; Christoph Henninger, Heidenheim, both of Germany

[73] Assignee: Voith Sulzer Papiermaschinen GmbH, Heidenheim, Germany

[21] Appl. No.: 670,502

[22] Filed: Jun. 27, 1996

[30] Foreign Application Priority Data

Jun. 30, 1995 [DE] Germany ..... 295 10 486.4

[51] Int. Cl.[6] ..... B05C 3/02

[52] U.S. Cl. ..... 118/410; 118/118; 118/119; 118/126; 118/258; 118/413; 118/419; 101/363; 15/256.51; 15/256.52

[58] Field of Search ..... 118/118, 119, 118/126, 258, 410, 413, 419; 162/281; 101/350, 363; 15/256.51, 256.52

[56] References Cited

U.S. PATENT DOCUMENTS

| | | | |
|---|---|---|---|
| 3,339,485 | 9/1967 | Rytterholm | 101/363 |
| 4,245,582 | 1/1981 | Alheid et al. | 118/119 |
| 4,282,826 | 8/1981 | Wohlfeil | 118/118 |
| 4,367,691 | 1/1983 | Bergs | 118/119 |
| 4,773,351 | 9/1988 | Sollinger | 118/118 |
| 4,869,933 | 9/1989 | Sollinger et al. | 118/126 |
| 5,376,177 | 12/1994 | Elvidge et al. | 118/410 |
| 5,383,968 | 1/1995 | Rantanen et al. | 118/119 |
| 5,417,761 | 5/1995 | Bernert | 118/110 |
| 5,433,781 | 7/1995 | Bernert | 118/413 |
| 5,445,673 | 8/1995 | Bernert | 118/123 |
| 5,559,392 | 9/1996 | Liang et al. | 118/126 |
| 5,595,601 | 1/1997 | Lintula | 118/119 |

FOREIGN PATENT DOCUMENTS

| | | | |
|---|---|---|---|
| 0 541 502 | 6/1991 | European Pat. Off. | B05C 11/02 |
| 43 41 341 | 12/1993 | Germany | B05C 11/02 |
| 2 040 738 | 2/1979 | United Kingdom | B05C 11/02 |

*Primary Examiner*—Donald E. Czaja
*Assistant Examiner*—Michael P. Colaianni
*Attorney, Agent, or Firm*—Taylor & Associates, P.C.

[57] ABSTRACT

A roll doctor assembly as dosing element for a coater serving to coat a traveling web (e.g., paper web) features a rotatable doctor bar (14) that extends transversely across the web width. The doctor bar (14) is fitted in a doctor backing (12). The doctor backing (12) extends as well transversely across the web width. According to the invention, the doctor bar (14; 14'; 14") and the doctor backing (12; 12'; 12") are part of a modular system, so that the doctor bar is exchangeable for another with different outside diameter and, consequently, the doctor backing is exchangeable for another with different bearing diameter. The different doctor backings are adapted to one another to the effect that the axes of rotation of the different doctor bars (14; 14'; 14") assume the same position relative to the support beam (10).

7 Claims, 2 Drawing Sheets

ROLL DOCTOR ASSEMBLY

BACKGROUND OF THE INVENTION

1. Field of the Invention The present invention relates to a roll doctor assembly.

2. Description of the Related Art

A roll doctor in a coater for coating a traveling web (e.g., paper web), as is generally known, serves primarily as a dosing element. The roll doctor is forced with an accurately adjustable load against an applicator roll or directly on the web running over a backing roll, so that only part of the previously applied coating substance remains on the applicator roll or web, while the surplus share of coating substance is rejected.

A prior roll doctor assembly is described in DE 43 08 302 A1 (PA 05053).

SUMMARY OF THE INVENTION

The objective underlying the invention is to improve the prior roll doctor assembly to the effect that a rotatable doctor bar possessing a given outside diameter can be exchanged for one with a different diameter. Such exchange is meant to be possible maximally quickly and at maximally low expense.

An important idea of the invention is that the axis of rotation of the "new" doctor bar, upon exchange of one doctor bar for another with different diameter, is relative to the support beam in the same position as the axis of rotation of the previous doctor bar. The advantage obtained thereby is that the position of the doctor bar drive remains unchanged.

Another aspect of the present invention is that the position of the load system remains unchanged.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
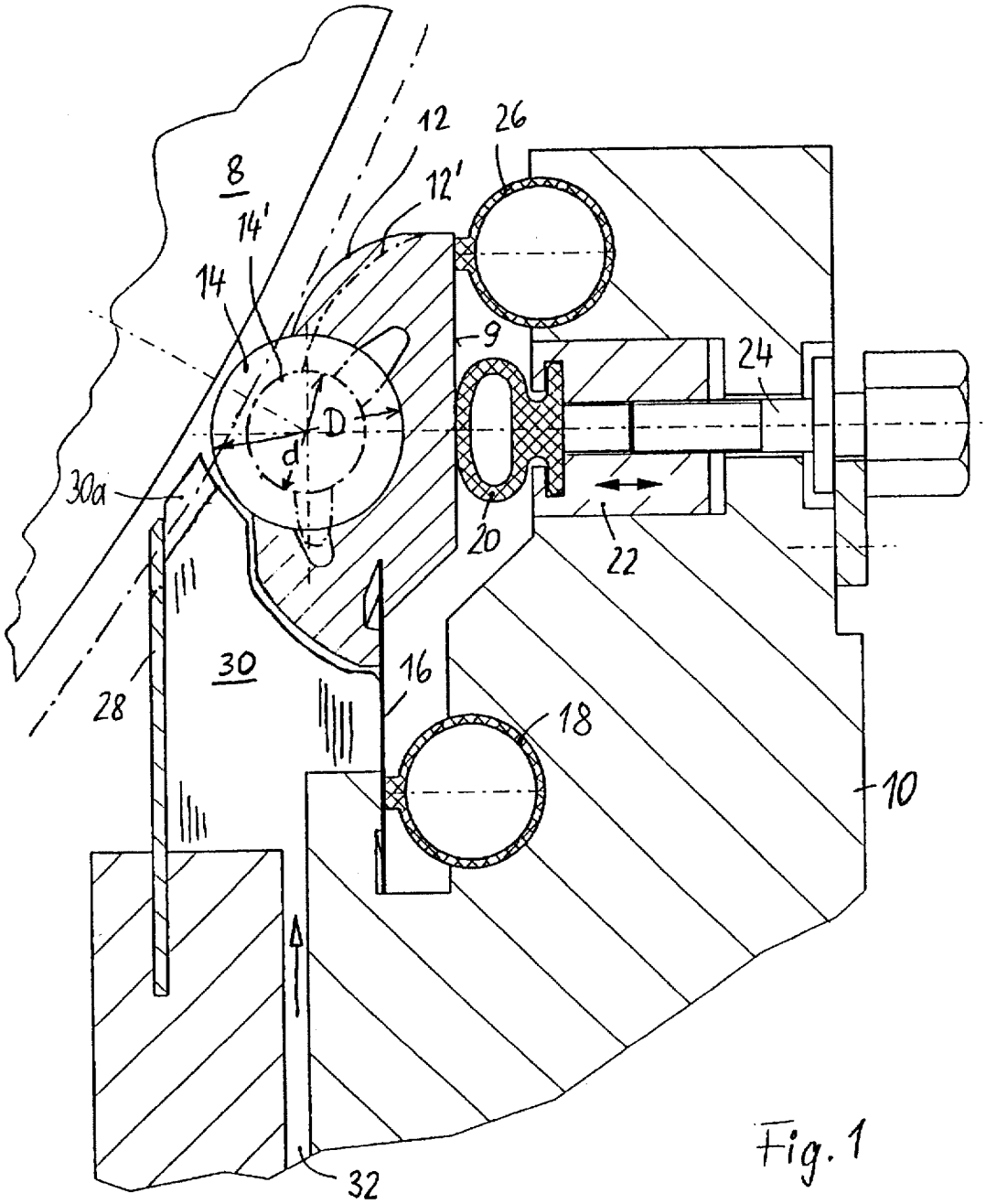
FIG. 1 is a schematic, cross sectional view of an embodiment of a roll doctor assembly of the present invention.

Referring now to the drawings and particularly to FIG. 1, there is shown, in solid lines, a roll doctor assembly featuring a doctor bar 14 with a relatively large doctor bar diameter D. Illustrated additionally, by dash-dot lines, is a modified roll doctor assembly (doctor bar 14') with a smaller doctor bar diameter d. As can be seen, the two roll doctor assemblies differ in only very few details. In particular, the positions of the axes of rotation of the two roll doctors 14 and 14', based on the support body 10, coincide. Equally, the rearward outside 9 of the respective doctor backing 12 is in both variants spaced the same distance from the support body 10.

One of the essential elements of the roll doctor assembly is the previously mentioned (and only partly visible) support body 10, which extends transversely through the machine. It is pivotable in customary fashion relative to the roll 8. The roll 8 defines an applicator element which may be an applicator roll on which a film of coating substance is formed which the roll 8 transfers, at a point not visible, to the paper web. But roll 8 can also pass the paper web being coated directly along the roll doctor assembly. A roll doctor 14 is rotatably mounted in the previously mentioned doctor backing 12. The doctor backing 12 is fitted in the support body 10 by means of a base strip 16, which presently has the shape of a blade, and by means of an inflatable clamping tube 18. As a variation, a single-part doctor backing with a base strip molded to it can be used. Upon pressure relief of clamping tube 18, the doctor backing 12 can be removed from the support body 10 along with the doctor bar 14 and base strip 16.

Further known elements are a load system with an as well inflatable pressure tube 20 which bears within a load bar 22. Load bar 22, in turn, bears on support body 10 by means of a plurality of spindles 24 that are distributed across the web width and allow individual adjustment. This system serves in known fashion to achieve a maximally uniform thickness cross profile of the applied coating.

Near the top end of the rearward outside surface 9, an additional pressure tube 26 may be provided to force the flanks of the doctor backing on the doctor bar (sealing the lubrication grooves).

When it is desired to insert, e.g., instead of the doctor bar 14 with diameter D a doctor bar 14' with a smaller diameter d, substantially only (in addition to the doctor bar) the doctor backing 12 needs to be replaced by the doctor backing 12'. The two doctor backings 12 and 12' differ normally (besides the different bearing diameters) only by the different upper bounding surfaces, indicated at 12 and 12'. Since in such doctor bar exchange the distance between roll 8 and support body 10 changes, also the deckle shields 30 must normally be replaced by such with modified dimensions; or an extension **30*a* is removed from the deckle shield 30. On the back-up strip 28, the measures set forth in claims 3, 4 or 5** may selectively be chosen.

It should also be mentioned that the doctor backing 12 with the doctor bar 14, the back-up strip 28 and the deckle shields 30 bound an applicator chamber, into which empties a feed duct 32 for the liquid coating substance.

Figure 2:
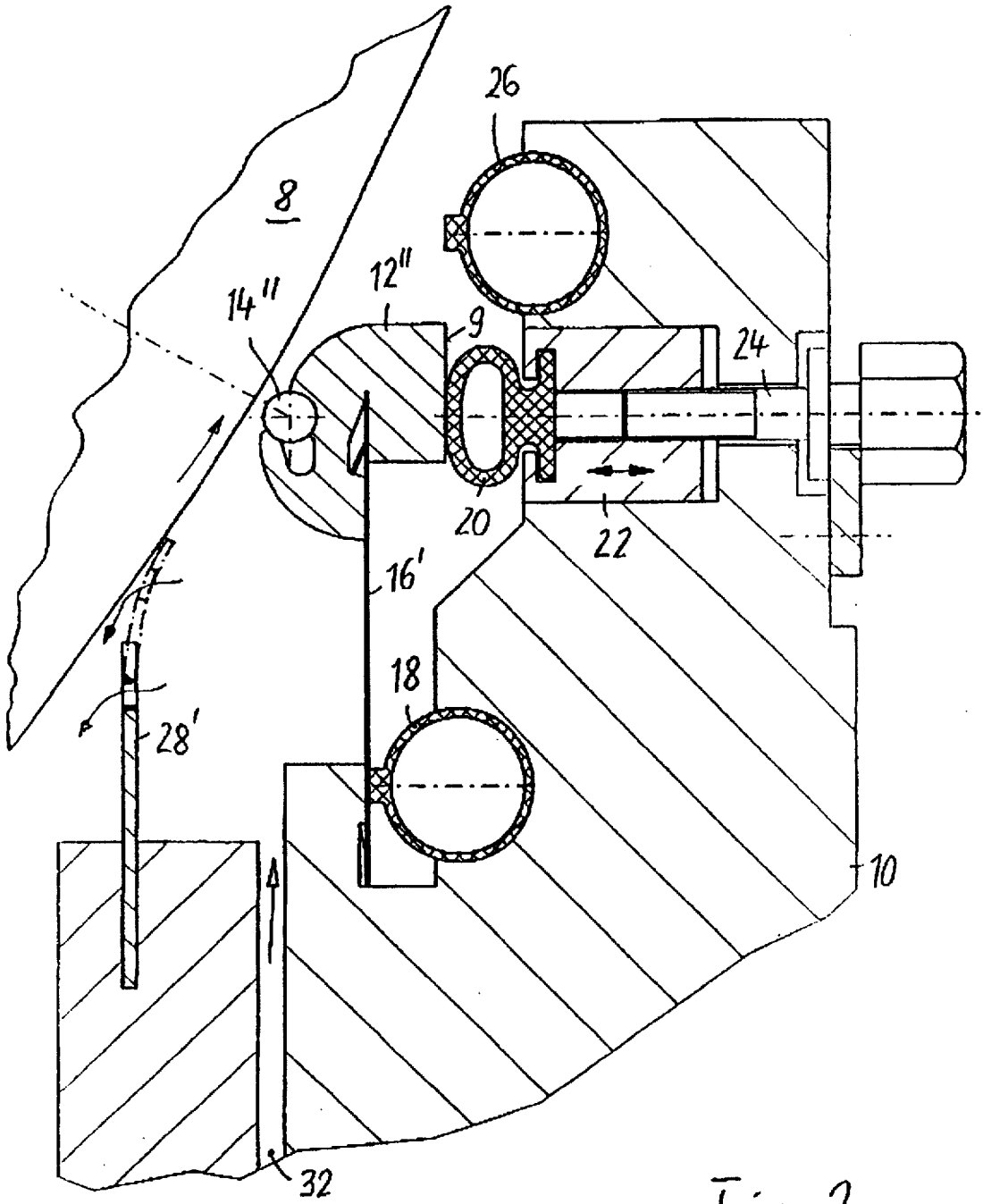
FIG. 2 is a schematic, cross sectional view of another embodiment of a roll doctor assembly of the present invention.

In FIG. 2, unchanged components are referenced the same as in FIG. 1. Installed here is a doctor bar 14" with a diameter reduced further still, along with a doctor backing 12" adapted thereto, and with an extended base strip 16'. The additional pressure tube 26 is in this case ineffective. Also illustrated is a shortened back-up strip 28'. Adapted as well, the deckle shields have been omitted in FIG. 2.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A roll doctor assembly for use as a dosing element in a coater for coating with a coating mixture a traveling web having a width, said roll doctor assembly comprising:

a doctor bar comprising a selected one of a plurality of doctor bars, said plurality of doctor bars having a plurality of different predetermined diameters, each said doctor bar having an axis of rotation;

a doctor backing comprising a selected one of a plurality of doctor backings, each said doctor backing being associated with and configured to rotatably carry a respective said doctor bar, each said doctor backing having a predetermined bearing diameter which is at all times approximately equal to said diameter of said associated doctor bar, said selected doctor backing and said respective doctor bar extending transversely across the width of the traveling web;

a support beam;

a flexible base strip interconnecting said selected doctor backing with said support beam;

an applicator element for one of carrying the traveling web to be directly coated, and transferring the coating mixture to the traveling web to be indirectly coated; and a loading device which biases said selected doctor backing against one of said applicator element and the traveling web;

wherein each of said doctor backings and said respective doctor bars are configured such that said axis of rotation of said doctor bar carried by any said selected doctor backing is at approximately the same position relative to said support beam.

2. The roll doctor assembly according to claim 1, wherein each said doctor backing includes a rearward outside surface, said doctor backings being configured such that said rearward outside surface of any said selected doctor backing is at approximately the same position relative to said support beam.

3. The roll doctor assembly according to claim 1, further comprising a back-up strip which together with said applicator element, said selected doctor backing and said respective doctor bar define an applicator chamber, said back-up strip comprising one of a plurality of differently configured back-up strips respectively associated with said plurality of doctor bars.

4. The roll doctor assembly according to claim 3, wherein each said back-up strip includes a different height.

5. The roll doctor assembly according to claim 3, wherein said back-up strip includes a plurality of overflow openings and flexibly bears on one of said applicator element and the traveling web.

6. The roll doctor assembly according to claim 1, wherein said applicator element comprises an applicator roll.

7. A roll doctor assembly for use as a dosing element in a coater for coating with a coating mixture a traveling web having opposing edges and a width, said roll doctor assembly comprising:

two deckle shields disposed in the area of the web edges, and two extension pieces respectively attached to said deckle shields;

a doctor bar comprising a selected one of a plurality of doctor bars, said plurality of doctor bars having a plurality of different diameters, each said doctor bar having an axis of rotation;

a doctor backing comprising a selected one of a plurality of doctor backings, each said doctor backing being associated with and configured to rotatably carry a respective said doctor bar, said selected doctor backing and said respective doctor bar extending transversely across the width of the traveling web;

a support beam;

a flexible base strip interconnecting said selected doctor backing with said support beam; and a loading device which biases said selected doctor backing against the traveling web.

* * * * *